US007063587B1

(12) United States Patent
Lin

(10) Patent No.: US 7,063,587 B1
(45) Date of Patent: Jun. 20, 2006

(54) BUILDING BLOCK

(75) Inventor: Fu-Chi Lin, Taipei Hsien (TW)

(73) Assignee: Youth Toy Enterprise Co., Ltd., Taipei (TW)

( * ) Notice: Subject to any disclaimer, the term of this patent is extended or adjusted under 35 U.S.C. 154(b) by 0 days.

(21) Appl. No.: 11/051,931

(22) Filed: Feb. 4, 2005

(51) Int. Cl.
*A63H 33/00* (2006.01)
*A63F 9/12* (2006.01)

(52) U.S. Cl. ..... 446/124; 446/120; 446/128; 273/156; 273/157 R

(58) Field of Classification Search ..... 446/117, 446/120, 121, 122, 123, 124, 125, 126, 127, 446/128; 273/153 S, 155, 157 R, 160
See application file for complete search history.

(56) References Cited

U.S. PATENT DOCUMENTS 4,377,916 A * 3/1983 Komiya ..... 446/487
4,392,323 A * 7/1983 Rubik ..... 446/487
4,484,406 A * 11/1984 Matsumoto et al. ..... 446/487
6,034,821 A * 3/2000 Schenfeld et al. ..... 359/618
6,679,780 B1 1/2004 Shih

* cited by examiner

*Primary Examiner*—Nini F. Legesse

(57) ABSTRACT

A building block includes two perpendicularly connected square frames, and a hypotenuse frame extended between outer edges of the two square frames. Each of the square and hypotenuse frames has an outer frame portion and an inner cross-shaped rib portion having a thickness twice as large as that of the outer frame portion. The cross-shaped rib portion divides a space enclosed in each frame into four equal divisions, which are four cavities on one of the two square frames; two diagonally opposite round connecting posts and two diagonally opposite cavities on the other square frame; and two diagonally opposite connecting protrusions and two diagonally opposite rectangular cavities on the hypotenuse frame, so that a plurality of the building blocks could be assembled together in different manners to form changeful shapes via engagement of the cavities with corresponding connecting posts or protrusions.

4 Claims, 7 Drawing Sheets

BUILDING BLOCK

FIELD OF THE INVENTION

The present invention relates to a building block, and more particularly to building blocks that could be linearly and/or angularly connected to one another in different manners to show changeful shapes.

BACKGROUND OF THE INVENTION

U.S. Pat. No. 6,679,780 discloses a cubic building block formed from a plurality of connected frame portions having a predetermined thickness. The building block is provided at each side with a cross-shaped rib portion having a thickness smaller than that of the frame portion, so that a space enclosed in each frame portion is divided into four squared cavities. The building block is also provided in the frame portion on at least one side thereof with two diagonally opposite round connecting posts, so that the two round connecting posts respectively have a center just located at a center of a corresponding square cavity on any other side of the building block, and a diameter equal to each side of the squared cavity. When any two of the above-described building blocks are vertically or horizontally juxtaposed for two complete sides on the two building blocks to face each other, the round connecting posts on a first building block could always be aligned with the square cavities on another building block. Therefore, the two building blocks could always be effectively connected or stacked at two complete sides facing each other through engagement of the round connecting posts on one building block with corresponding square cavities on another one building block.

Since the building blocks disclosed in U.S. Pat. No. 6,679,780 must be connected or stacked through full contact of two complete sides on two different building blocks, only limited connecting manners could be employed and only very limited shapes could be formed from assembling of these building blocks. The building blocks of U.S. Pat. No. 6,679,780 are therefore less attractive and less competitive in the existing commercial environments.

It is therefore tried by the inventor to develop a building block to overcome the drawbacks existed in the conventional building blocks.

SUMMARY OF THE INVENTION

A primary object of the present invention is to provide a building block that has a structure allowing a plurality of the building blocks to connect together in more different manners, so that more changeful shapes could be formed to create more fun.

To achieve the above and other objects, the building block according to the present invention includes two square frames perpendicularly connected together at inner edges thereof, and a hypotenuse frame extended between outer edges of the two square frames, such that an isosceles right triangle is formed at each lateral side of the two perpendicularly connected square frames of the building block. Each of the square and hypotenuse frames has an outer frame portion and an inner cross-shaped rib portion having a thickness twice as large as that of the outer frame portion. The cross-shaped rib portion divides a space enclosed in each frame into four equal divisions, which are four cavities on one of the two square frames; two diagonally opposite round connecting posts and two cavities diagonally located at two sides of the two round connecting posts on the other square frame; and two diagonally opposite connecting protrusions and two rectangular cavities diagonally located at two sides of the two connecting protrusions on the hypotenuse frame, so that a plurality of the building blocks could be assembled together in more different manners to form more changeful shapes via engagement of the cavities with corresponding connecting posts and/or protrusions.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
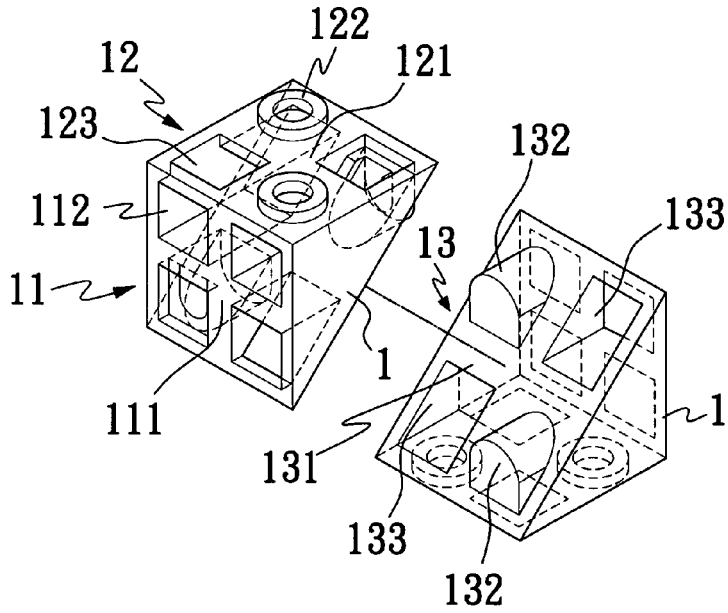
FIG. 1 shows two pieces of building block according to a first embodiment of the present invention viewed from two opposite directions.
Figure 2:
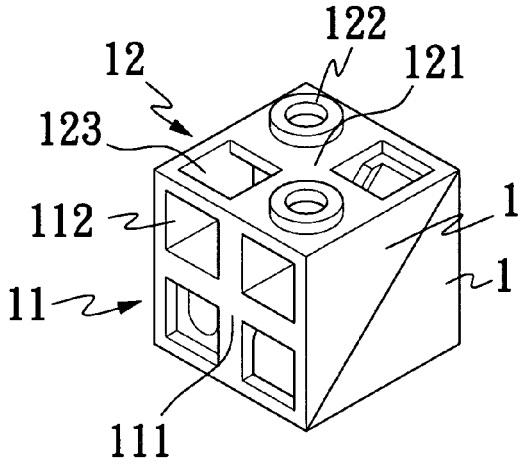
FIG. 2 shows the two building blocks of FIG. 1 are connected to each other at respective hypotenuse frames.
Figure 3:
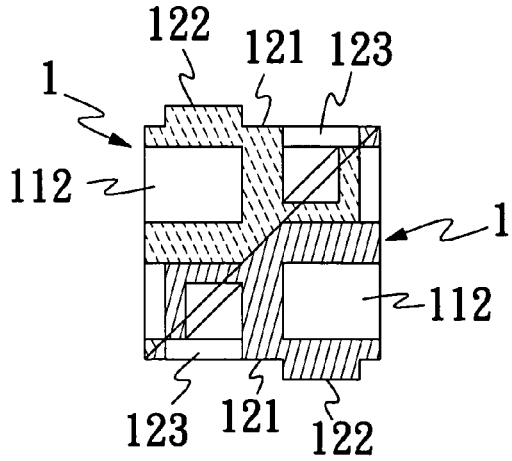
FIG. 3 is a sectional view of FIG. 2.

Please refer to FIG. 1 in which two pieces of building block 1 according to a first embodiment of the present invention are shown in two opposite directions, and to FIGS. 2 and 3 that are perspective and sectional views, respectively, showing the two building blocks 1 of FIG. 1 are connected to each other at respective hypotenuse frames thereof.

As shown, each of the building blocks 1 includes a first and a second square frame 11, 12 perpendicularly connected to each other at inner edges thereof, and a hypotenuse frame 13 extended between outer edges of the first and the second frame 11, 12, such that an isosceles right triangle is formed at each lateral side of the perpendicularly connected first and second square frames 11, 12 of the building block 1. The first and second square frames 11, 12 and the hypotenuse frame 13 respectively have an outer frame portion and a cross-shaped rib portion 111, 121, 131 located within the outer frame portion. These cross-shaped rib portions 111, 121, 131 have a thickness twice as large as that of the outer frame portion. The cross-shaped rib portion 111 divides a space enclosed in the first square frame 11 into four cavities 112. The second square frame 12 includes two diagonally opposite round connecting posts 122, and two cavities 123 diagonally located at two sides of the two round connecting posts 122. The hypotenuse frame 13 includes two diagonally opposite connecting protrusions 132, and two rectangular cavities 133 diagonally located at two sides of the two connecting protrusions 132. With these arrangements, any two building blocks 1 could be connected together at the hypotenuse frames 13 by engaging the connecting protrusions 132 of a first building block 1 with the rectangular cavities 133 of a second building block 1, as shown in FIGS. 2 and 3. Alternatively, any two building blocks 1 could be connected together at two square frames 11 or 12 by engaging the round connecting posts 122 of a first building block 1 with the cavities 112 or 123 of a second building block 1.

Figure 4:
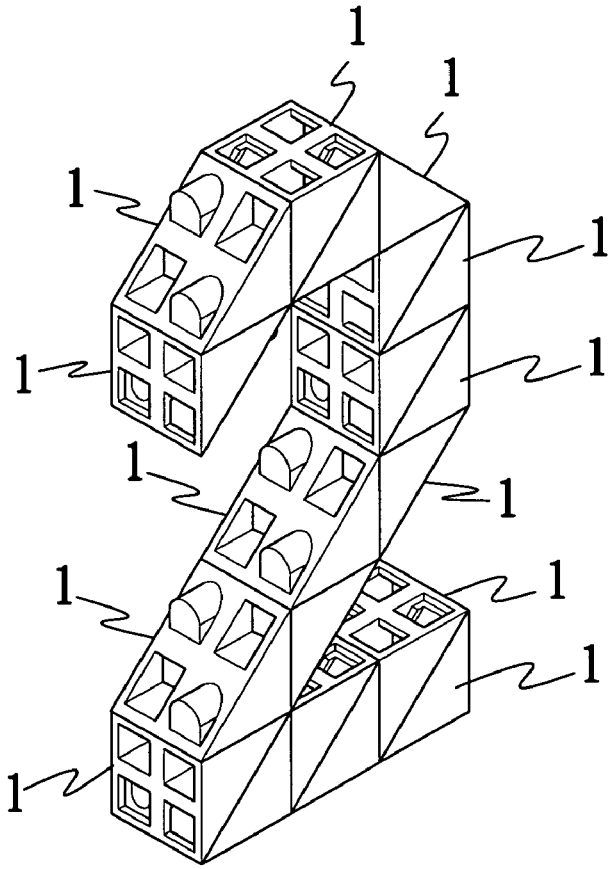
FIG. 4 shows a first example of shape assembled from multiple pieces of the building block of FIG. 1.
Figure 5:
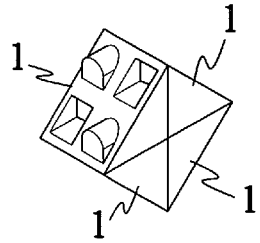
FIG. 5 shows a second example of shape assembled from multiple pieces of the building block of FIG. 1.
Figure 6:
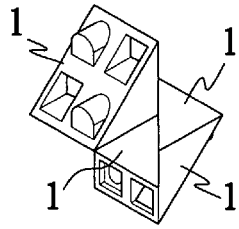
FIG. 6 shows a third example of shape assembled from multiple pieces of the building block of FIG. 1.
Figure 7:
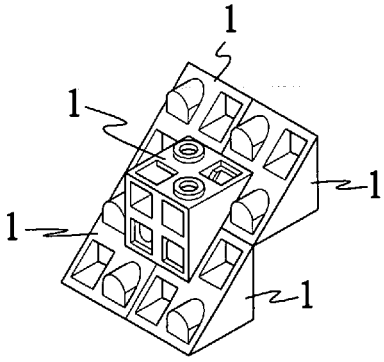
FIG. 7 shows a fourth example of shape assembled from multiple pieces of the building block of FIG. 1.
Figure 8:
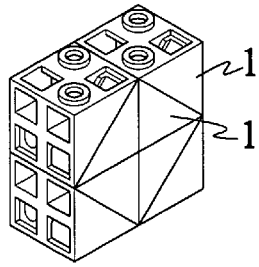
FIG. 8 shows a fifth example of shape assembled from multiple pieces of the building block of FIG. 1.

FIGS. 4, 5, 6, 7, and 8 show several examples of shapes assembled from the building blocks 1 according to the first embodiment of the present invention. As can be clearly seen from these examples, when the building blocks 1 are connected together at the hypotenuse frames 13, all the connecting protrusions 132 of a first building block 1 could be correctly aligned with the rectangular cavities 133 of an opposite second building block 1; and when the building blocks 1 are connected together at a first square frame 11 and a second square frame 12 or at two second square frames 12, all the round connecting posts 122 of a first building block 1 could be correctly aligned with the cavities 112 or 123 of an opposite second building block 1. Therefore, a plurality of building blocks 1 could be linearly or angularly connected in different manners to show changeful shapes simply by engaging the round connecting posts 122 with corresponding cavities 112 or 123, or engaging the connecting protrusions 132 with corresponding rectangular cavities 133, as shown in FIGS. 4, 5, and 8. Moreover, since the cross-shaped rib portions of the square and hypotenuse frames 11, 12, 13 are twice as thick as the outer frame portions, a distance between two round connecting posts 122 or two connecting protrusions 132 would never be smaller than a total thickness of two outer frame portions of two square frames of two vertically or horizontally juxtaposed building blocks 1. Therefore, it is possible for a first building block 1 to stack on and straddle two second building blocks 1 simply by engaging the round connecting posts 122 or the connecting protrusions 132 of the first building block 1 with the cavities 112, 123 or the rectangular cavities 133 of the two second building blocks 1, as shown in FIGS. 6 and 7.

Figure 9:
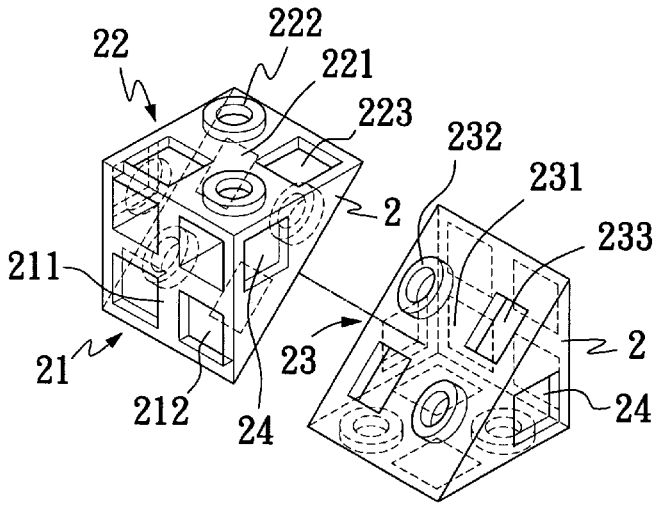
FIG. 9 shows two pieces of building block according to a second embodiment of the present invention viewed from two opposite directions.
Figure 10:
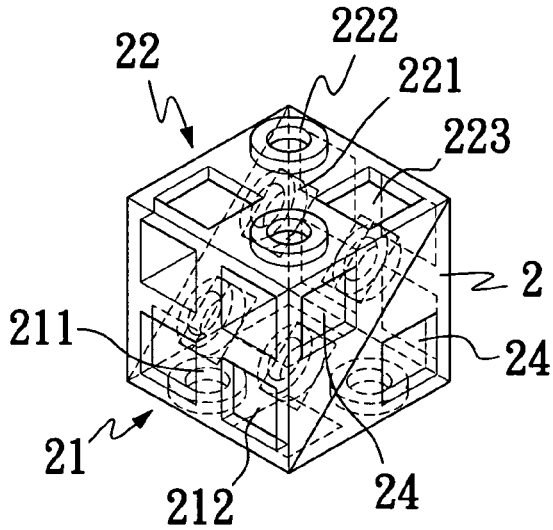
FIG. 10 shows the two building blocks of FIG. 9 are connected to each other at respective hypotenuse frames.
Figure 11:
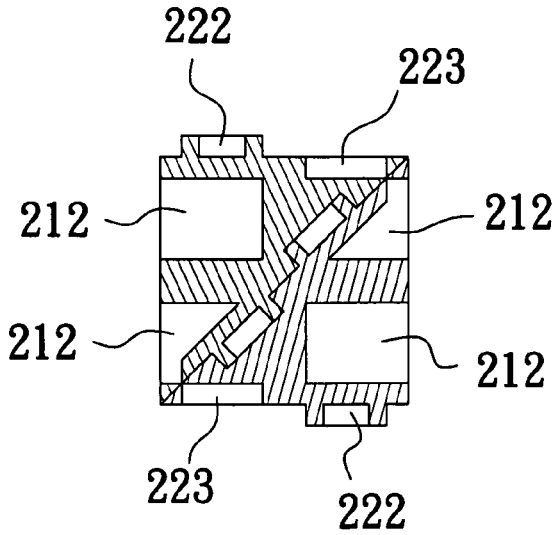
FIG. 11 is a sectional view of FIG. 10.

FIG. 9 shows two pieces of building block 2 according to a second embodiment of the present invention viewed from two opposite directions, and FIGS. 10 and 11 are perspective and sectional views, respectively, showing the two building blocks 2 of FIG. 9 are connected to each other at respective hypotenuse frames.

As can be clearly seen from FIGS. 9, 10, and 11, the building block 2 according to the second embodiment of the present invention includes a first and a second square frame 21, 22 perpendicularly connected to each other at inner edges thereof, and a hypotenuse frame 23 extended between outer edges of the first and the second frame 21, 22, such that an isosceles right triangle is formed at each lateral side of the perpendicularly connected first and second square frames 21, 22 of the building block 2. The first and second square frames 21, 22 and the hypotenuse frame 23 respectively have an outer frame portion and a cross-shaped rib portion 211, 221, 231 located within the outer frame portion. The cross-shaped rib portions 211, 221, 231 have a thickness twice as large as that of the outer frame portion. The cross-shaped rib portion 211 divides a space enclosed in the first square frame 21 into four cavities 212. The second square frame 22 includes two diagonally opposite round connecting posts 222, and two cavities 223 diagonally located at two sides of the two round connecting posts 222. The hypotenuse frame 23 includes two diagonally opposite round connecting posts 232, and two rectangular cavities 233 diagonally located at two sides of the two round connecting posts 232. Moreover, a cavity 24 is provided at each of the isosceles right triangles at two lateral sides of the building block 2. With these arrangements, any two building blocks 2 could be connected together at the hypotenuse frames 23 by engaging the round connecting posts 232 of a first building block 2 with the rectangular cavities 233 of a second building block 2, as shown in FIGS. 10 and 11.

Figure 12:
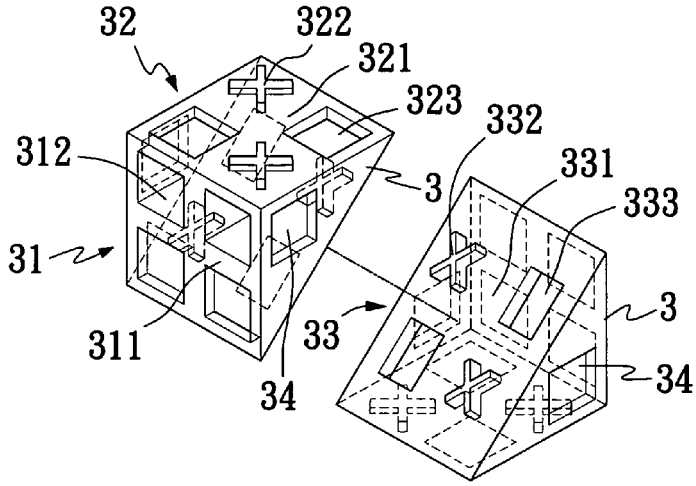
FIG. 12 shows two pieces of building block according to a third embodiment of the present invention viewed from two opposite directions.

FIG. 12 shows two pieces of building block 3 according to a third embodiment of the present invention viewed from two opposite directions. As can be clearly seen from FIG. 12, the building block 3 according to the third embodiment of the present invention includes a first and a second square frame 31, 32 perpendicularly connected to each other at inner edges thereof, and a hypotenuse frame 33 extended between outer edges of the first and the second frame 31, 32. The first and second square frames 31, 32 and the hypotenuse frame 33 respectively have an outer frame portion and a cross-shaped rib portion 311, 321, 331 located within the outer frame portion. These cross-shaped rib portions 311, 321, 331 have a thickness twice as large as that of the outer frame portion. The cross-shaped rib portion 311 divides a space enclosed in the first square frame 31 into four cavities 312. The second square frame 32 includes two diagonally opposite cross-shaped connecting protrusions 322, and two cavities 323 diagonally located at two sides of the two cross-shaped connecting protrusions 322. The hypotenuse frame 33 includes two diagonally opposite cross-shaped connecting protrusions 332, and two rectangular cavities 333 diagonally located at two sides of the two cross-shaped connecting protrusions 332. Moreover, a cavity 34 is provided on an isosceles right triangle at each lateral side of the building block 3. With these arrangements, a plurality of the building blocks 3 could be connected together in different manners to show different shapes just as the building blocks 1 and 2.

Figure 13:
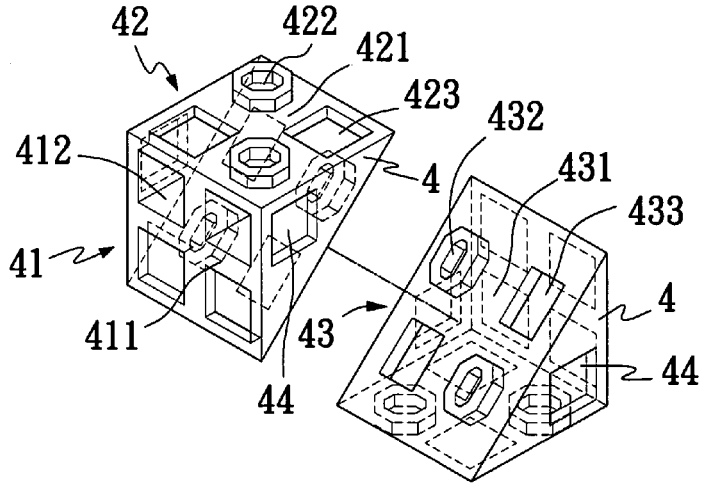
FIG. 13 shows two pieces of building block according to a fourth embodiment of the present invention viewed from two opposite directions.

FIG. 13 shows two pieces of building block 4 according to a fourth embodiment of the present invention viewed from two opposite directions. As can be clearly seen from FIG. 13, the building block 4 according to the fourth embodiment of the present invention includes a first and a second square frame 41, 42 perpendicularly connected to each other at inner edges thereof, and a hypotenuse frame 43 extended between outer edges of the first and the second frame 41, 42. The first and second square frames 41, 42 and the hypotenuse frame 43 respectively have an outer frame portion and a cross-shaped rib portion 411, 421, 431 located within the outer frame portion. These cross-shaped rib portions 411, 421, 431 have a thickness twice as large as that of the outer frame portion. The cross-shaped rib portion 411 divides a space enclosed in the first square frame 41 into four cavities 412. The second square frame 42 includes two diagonally opposite regular polygonal connecting posts 422, and two cavities 423 diagonally located at two sides of the two regular polygonal connecting posts 422. The hypotenuse frame 43 includes two diagonally opposite regular polygonal connecting posts 432, and two rectangular cavities 433 diagonally located at two sides of the two regular polygonal connecting posts 432. Moreover, a cavity 44 is provided on an isosceles right triangle at each lateral side of the building block 4. With these arrangements, a plurality of the building blocks 4 could be connected together in different manners to show different shapes just as the building blocks 1, 2, and 3.

With the above arrangements, the building blocks of the present invention could be connected and stacked in more changeful manners and are therefore improved, novel, and more practical and interesting for use.

What is claimed is:

1. A building block, comprising a first and a second square frame perpendicularly connected to each other at inner edges thereof, and a hypotenuse frame extended between outer edges of said first and said second frame; said first and second square frames and said hypotenuse frame respectively having an outer frame portion and a cross-shaped rib portion located within said outer frame portion; said cross-shaped rib portion on each of said square and hypotenuse frames dividing a space enclosed in said frame into four equal divisions; and said four equal divisions being four cavities on said first square frame, being two diagonally opposite connecting protrusions and two cavities diagonally located at two sides of said two connecting protrusions on said second square frame; and being two diagonally opposite connecting protrusions and two rectangular cavities diagonally located at two sides of said two connecting protrusions on said hypotenuse frame.

2. The building block as claimed in claim 1, wherein said cross-shaped rib portions on said square and said hypotenuse frames have a thickness twice as large as that of said outer frame portion of said square and said hypotenuse frames.

3. The building block as claimed in claim 1, wherein said connecting protrusions are in the shapes selected from the group consisting of round posts, cross-shaped protrusions, and regular polygonal posts.

4. The building block as claimed in claim 1, further comprising a cavity provided on a right triangle at each lateral side of said perpendicularly connected first and second square frames of said building block.

* * * * *